US006402053B1

(12) United States Patent
Chih

(10) Patent No.: US 6,402,053 B1
(45) Date of Patent: Jun. 11, 2002

(54) MULTIFUNCTION CAR WASH GUN STRUCTURE

(76) Inventor: Ti-An Chih, No. 5, Tyan Yang Lane, Jaw An Li, Luh Kang Chen, Chang Hua Hsien (TW)

( * ) Notice: Subject to any disclaimer, the term of this patent is extended or adjusted under 35 U.S.C. 154(b) by 0 days.

(21) Appl. No.: 09/627,160

(22) Filed: Jul. 27, 2000

(30) Foreign Application Priority Data

Aug. 7, 1999 (TW) ..... 88213620 U

(51) Int. Cl.[7] ..... B05B 7/26

(52) U.S. Cl. ..... 239/310; 239/305; 239/307; 239/317; 239/414; 239/526; 239/581.1

(58) Field of Search ..... 239/303, 304, 239/305, 307, 310, 317, 407, 413, 414, 526, 581.1

(56) References Cited

U.S. PATENT DOCUMENTS 4,572,235 A * 2/1986 Katzer et al. ..... 137/268

4,785,850 A * 11/1988 Sanchez ..... 239/317

* cited by examiner

*Primary Examiner*—Lesley D. Morris
*Assistant Examiner*—Christopher S. Kim
(74) *Attorney, Agent, or Firm*—Troxell Law Office PLLC

(57) ABSTRACT

A multifunction car wash gun including a car wash gun body, a connector, an adjustment mount, a sleeve, a setting sleeve, and a nozzle. The connector is fastened to the car wash gun body and has a water passage formed that is in continuity with the water passage in the car wash gun body. A soap solution output hole of the water passage is situated in the lower receptacle. The adjustment mount is installed at the bottom end of the connector. The sleeve is filled with a soap solution and installed into the lower receptacle. A liquid wax chamber is attached between the connector and the car wash gun body. A user can directly rotate the adjustment mount to selectively control water flow stoppage, water-only output, a combination water and soap solution output, and a combination water and liquid wax output.

2 Claims, 12 Drawing Sheets

FIG1-B
PRIOR ART

FIG1-A
PRIOR ART

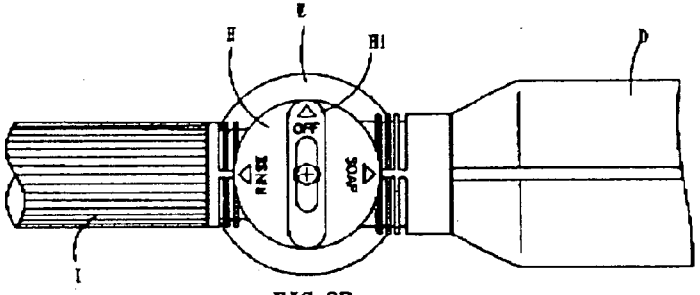
FIG. 2F
PRIOR ART
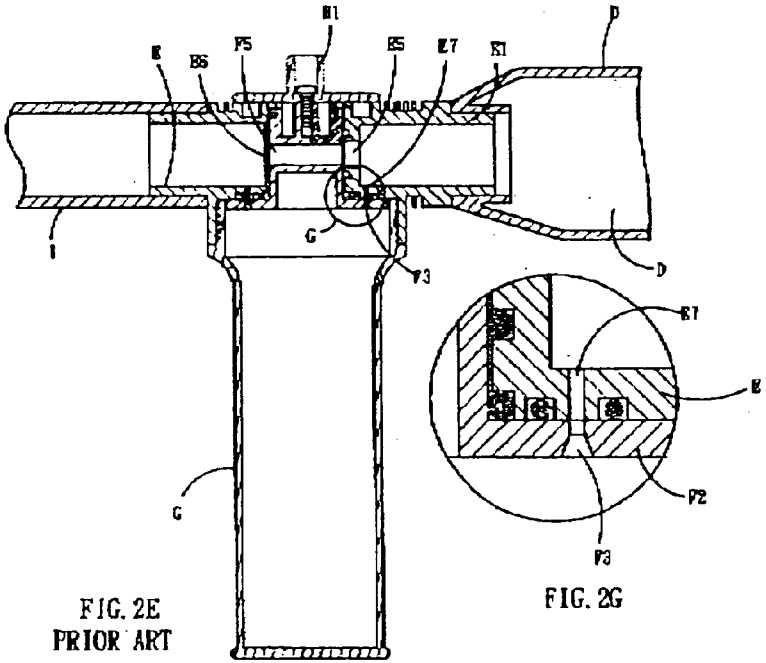
FIG. 2G
FIG. 2E
PRIOR ART

31
K
O
6
3

38
39
31
45
44
3

39
38
31
45
35
43
D
6
3
4
44
36
5

38
39
31
6
35
45
4

MULTIFUNCTION CAR WASH GUN STRUCTURE

BACKGROUND OF THE INVENTION

1) Field of the Invention

This invention relates to a multifunction car wash gun structure that improves upon the shortcomings of conventional car wash gun guns that are only capable of providing for the discharge of water alone or a combination of water and soap solution. The present invention is also ergonomically designed in that it provides a directly rotatable adjustment mount for the convenient controlling of the water-off, water-only, combination water and soap, and water and liquid wax output modes of the car wash gun structure.

2) Description of the Prior Art

Conventional car wash gun structures, as indicated in FIG. 1, FIG. 1-A, and FIG. 1-B, are comprised of an adjustable spray nozzle A (the prior art structural convent of which is commonplace and, therefore, needs no further elaboration), a water hose S, an attached connector tube circuit B, and a soap solution input hole B1 in the top surface of the said connector circuit B. A leakproof gasket is installed at the front and rear faces of the connector tube circuit, with a cleaning solution injector hole formed in the periphery of the top end for the slide operation of the cleaning solution chamber unit C by the connector tube circuit B. After the interior section of the cleaning solution chamber unit C is ensleeved over the connector tube circuit B, the interior section forms a soap solution cavity C2 for the injection of the soap solution. Finally, the leakproof gaskets C21 are respectively placed at the two sides of the soap solution input hole B1 between the front end and annular edge of the soap solution cavity C2, and the front end and top surface of the connector tube circuit B. The two leakproof gaskets C21 allow the entire cleaning solution chamber unit C to slide for purposes of control.

Following the assembly of the aforementioned structure, the water hose S supplies a flow of water into the interior section of the connector tube circuit B to thereby provide output from the end of the nozzle A. When a water-only water flow is desired, the entire cleaning solution chamber unit C is directly slid such that the two leakproof gaskets C21 nearest the front end and annular edge of the soap solution space C2 block the soap solution input hole B1 at the front section and top surface of the connector tube circuit B (as shown in FIG. 1-B). When a soap solution is desired, the two leakproof gaskets 21 nearest the interior section front end and annular edge of the said soap solution chamber unit F are slid to the soap solution input holes B1 at the front end and top surface of the connector tube circuit B, causing the said soap solution input hole B1 to be in communication with the soap solution chamber unit C (as shown in FIG. 1-A), thereby achieving a mixed flow through the interior section of the connector circuit E to provide a usable water and soap solution.

While the conventional structure is only capable of providing a water-only, or a combination water and soap solution, when utilized as a car wash gun to wash cars, in addition to the soap and water mixture, the application of a wax and water mixture may be desired. It is incapable of such a function and the structural design cannot be enhanced to include a wax water output, with the exception of completely emptying out the soap solution contained in the soap solution chamber unit F and, cleaning and drying it, and then filling the unit with liquid wax. Such a task is quite inconvenient. Otherwise, a separate structural entity that can be filled with liquid wax is a necessary improvement.

Referring to FIG. 2, FIG. 2-A, and FIG. 2-B, another car wash gun structure is comprised of a car wash gun body D having a handle D1 with a water supply connector at the bottom end, a hollow water passage D2 disposed internally and a top end extending towards the front. A connector E of tubular shape, the end E1 of which is inserted into the top end and front extent of the car wash gun body D has receptacles E2 and E3 perpendicularly formed at the top and bottom, respectively, in the approximate center section, with an annular groove E21 formed in the top surface of the upper receptacle E2 and a threaded section E31 formed along the bottom end of the lower receptacle E3. A through-hole E4 of a relatively small diameter proceeds along the two receptacles E2 and E3, with the through-hole E4 having passages E5 and E6 formed in the center sectional parallel to the two sides which enable communication with the interior section of the connector E, and an output hole E7 situated in the lower receptacle E3.

The assembly also includes an adjustment mount F having a columnar element F1 at its upper section and a circular piece F2 at its bottom section. The top of the circular piece F2 is positioned with the soap solution output hole F3 aligned with the output hole E7 and an outer edge of the columnar element F1 is against the water-tight ring F4 attached to the bottom section such that when inserted into the bottom end of the lower receptacle E3 below the connector E, the upper section is inserted into the through-hole E4. This enables continuity between the passages E5 and E6 in the through-hole E4. A level flow passage F5 is formed with an annular groove F6 disposed along its top end and center, and an insertion latch rim F7 with a mounting hole F8 in the center is formed at the periphery of the annular groove F5.

A sleeve G that is filled with a soap or other cleaning solution has a threaded section G1 along the top exterior end which enables fastening to the threaded section E31.

A setting sleeve H has a rotatable knob H1 at its top section, a circular skirt H2 situated at its center section, and a catch slot H3 at its bottom section in the center of the circumferential edge, thereby enabling a fixed insertive positioning into the insertion latch rim F7 of the annular groove F6 disposed along its top end and center of the adjustment mount E. A mounting hole H4 is formed in the center of its top surface, enabling its fastening to the mounting hole F8 in the center and top surface of the adjustment mount H by means of the screw H5 such that when the rotatable knob H1 on the upper section of the setting sleeve H is turned during operation, the adjustment mount F is simultaneously rotated for purposes of control.

A connective tube I that is of hollow construction has an end which is inserted onto the front end of the connector E to form a unitary structural entity.

A nozzle J is inserted into the front end of the connective tube I to form a unitary structural entity and, furthermore, to provide a range of adjustable spraying patterns.

Following the assembly of this structure, as indicated in FIG. 2, FIG. 2-A, and FIG. 2-B, the user manually rotates and thereby adjusts the rotatable knob H1 of the setting sleeve H, causing the adjustment mount F to rotate such that the passages E5 and E6 in the through-hole E4 of the connector E above the adjustment mount F are not in continuity with the level flow passage F5 in the interior section of the connector E, blocking the water flow pathway formed from the end and initial portion of the water passage D2 placing the car wash gun in the water-off mode, wherein water is prevented from flowing to the connective tube I fastened to the front end of the connector E and precluded form discharging through the nozzle J.

Referring to FIG. 2, FIG. 2-C, and FIG. 2-D, when the user rotates and thereby adjusts the rotatable knob H1 of the setting sleeve H1, the adjustment mount F is rotated along such that passages E5 and E6 in the through-hole E4 of the connector E above the adjustment mount F are in continuity with the level flow passage F5 in the interior section of the connector E, opening the water flow pathway formed from the end and initial portion of the water passage D2 inside the car wash gun body D and placing the car wash gun in a water-on mode, wherein water flows through the connective tube I fastened to the front end of the connector E and is discharged from the nozzle.

Referring to FIG. 2, FIG. 2-E, and FIG. 2-F, when the user rotates and thereby adjusts the rotatable knob H1 of the setting sleeve H1, the adjustment mount F is rotated along such that passages E5 and E6 in the through-hole E4 of the connector E above the adjustment mount F are in continuity with the level flow passage F5 in the interior section of the connector E, opening the water flow pathway formed from the end and initial portion of the water passage D2 inside the car wash gun body D. Also due the output hole E7 formed in the lower receptacle E3 at the end pipe circuit E1 of the connector E is in a state of continuity with the soap solution output hole F3 in the circular piece F2 of the adjustment mount F, the entire car wash gun is capable of a controlled water flow in conjunction with the sleeve G fastened in the lower receptacle E3 at the bottom end connector E to output a combined soap solution.

The conventional structure is only capable of providing for water-only or combination water and soap solution usage, when utilized as a car wash gun to wash cars. In addition to the soap and water mixture, the application of a wax and water mixture may be desired, but it is incapable of such and the structural design cannot be enhanced to include a wax and water output, with the exception of completely emptying out the soap solution contained in the said soap solution chamber unit F, cleaning and drying it, and then filling the said unit with liquid wax. Such a task is quite inconvenient. Otherwise, a separate structural entity that can be filled with liquid wax is a needed improvement that would permit wax and water output operation. When the entire car was gun of the prior art is engaged in water-off, water-only, or combination soap solution output operation, one hand grasps the sleeve G or handle D1 of the car wash gun body D, while the other hand rotates the rotatable knob H1 of the setting sleeve H to thereby rotate and control the adjustment mount F. Therefore, this design results in inconvenient operation that similarly awaits improvement.

SUMMARY OF THE INVENTION

The primary objective of the invention herein is to provide a multifunction car wash gun structure comprised of a car wash gun body having a water passage formed inside and a top end that extends forward, a connector fastened to the top end and front extent of the car wash gun body that has a water passage formed inside that is in continuity with the water passage internally formed in the car wash gun body, and a nozzle attached to the end of the connector. A liquid wax chamber is attached between the end section of the connector and the car wash gun body, with a through-hole in the center of upper and lower receptacles situated at the liquid wax chamber, and an output hole, which in coordination with a mounting slot extending from the bottom section of the adjustment mount, enables the fastening of the sleeve. A soap solution output hole is positionally coordinated with the output hole in the lower receptacle from the water passage through the interior section of the connector. Two passages at the center section of the through-hole are in continuity with the water passage within the interior section of the connector, and a curved flow channel is formed into one side. Formed at the top end and at an appropriate position in the circumferential edge of the curved flow channel is a groove that is in continuity with the through-hole of the connector as well as the output hole of the liquid wax chamber, with a reverse profile washer, thereby enabling the blockage of the water flow. The user can directly rotate the adjustment mount to selectively control water flow stoppage, water-only output, combination water and soap solution output, and combination water and liquid wax output.

Another objective of the invention herein is to provide a multifunction car wash gun structure in which, when the entire car was gun is operated in the water flow stoppage, water-only output, combination water and soap solution output, or combination water and liquid wax output mode, the user stably grasps the handle of the car wash gun body with one hand, while the other hand turns the adjustment mount for operational control in a manner that is compatible with ergonomic design and operates consistently.

To enable a further understanding of the structural innovations, operation, and other related items, the brief description of the drawings is accompanied by the detailed description of the invention.

BRIEF DESCRIPTION OF THE DRAWINGS

FIG. 1-A is a cross-sectional view of a conventional combination cleaning solution-water gun structure in a first mode.

FIG. 1-B is a cross-sectional view of a conventional combination cleaning solution-water gun structure in a second mode.

FIG. 2-A is a partial cross-sectional view of the structure of FIG. 2 in a first mode.

FIG. 2-B is a partial top view of the structure of FIG. 2 in a first mode.

FIG. 2-C is a partial cross-sectional view of the structure of FIG. 2 in a second mode.

FIG. 2-D is a partial top view of the structure of FIG. 2 in a second mode.

FIG. 2-E is a partial cross-sectional view of the structure of FIG. 2 in a third mode.

FIG. 2-F is a partial top view of the structure of FIG. 2 in a third mode.

FIG. 2-G is an enlarged cross-sectional view of area G in FIG. 2-E.

FIG. 3-A is an exploded perspective view of the connector and the setting sleeve section of the present invention.

FIG. 4-A is a top view of the connector of FIG. 4.

FIG. 4-B is an enlarged cross-sectional view of area B in FIG. 4.

FIG. 5-A is a cross-sectional view of the connector of FIG. 5.

FIG. 5-B is a top view of the connector of FIG. 5.

FIG. 6-A is a cross-sectional view of the connector of FIG. 6.

FIG. 6-B is a top view of the connector of FIG. 6.

FIG. 7-A is a cross-sectional view of the connector of FIG. 7.

FIG. 7-B is a top view of the connector of FIG. 7.

FIG. 7-C is an enlarged cross-sectional view of area C of FIG. 7.

FIG. 8-A is a cross-sectional view of the connector of FIG. 2.

FIG. 8-B is a top view of the connector of FIG. 8.

FIG. 8-C is an enlarged cross-sectional view of area D in FIG. 8.

DETAILED DESCRIPTION OF THE INVENTION

Figure 1:
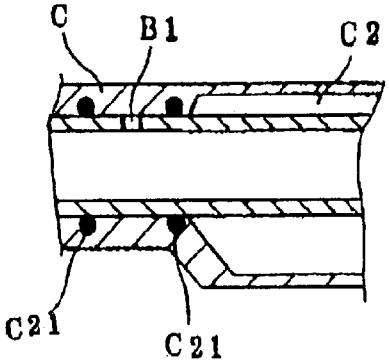
FIG1 PRIOR ART
FIG. 1 is a side view of a conventional combination cleaning solution-water gun structure.
Figure 1:
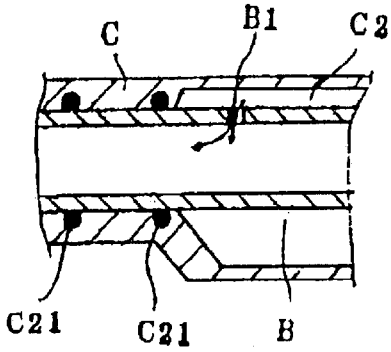
FIG1 PRIOR ART
Figure 1:
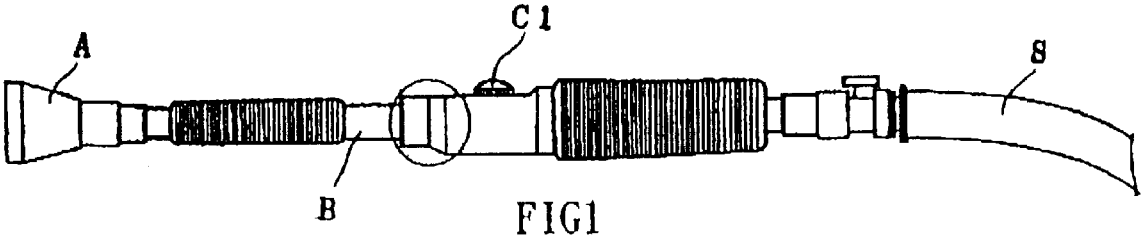
FIG1 PRIOR ART
Figure 2:
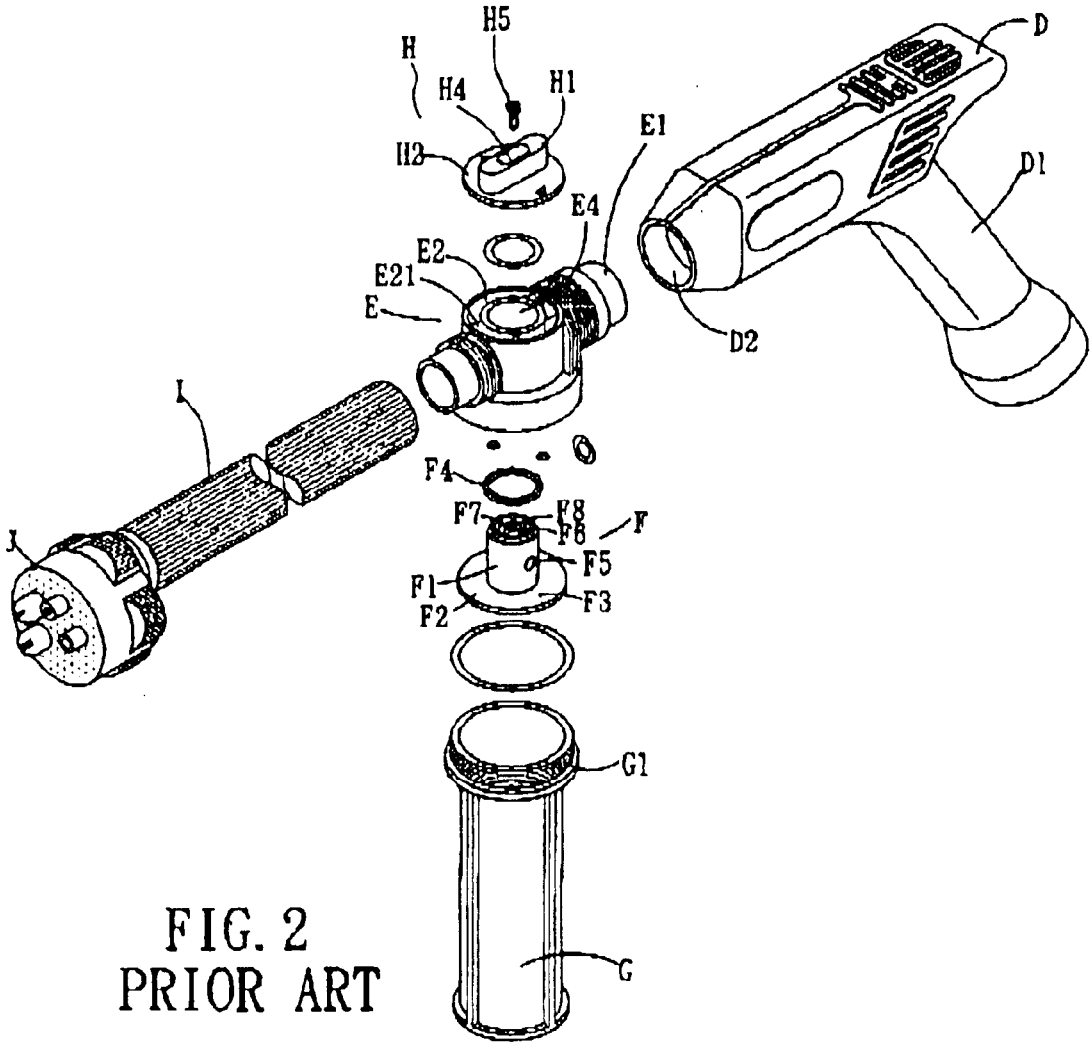
FIG. 2 PRIOR ART
FIG. 2 is an exploded perspective view of another conventional structure.
Figure 2B:
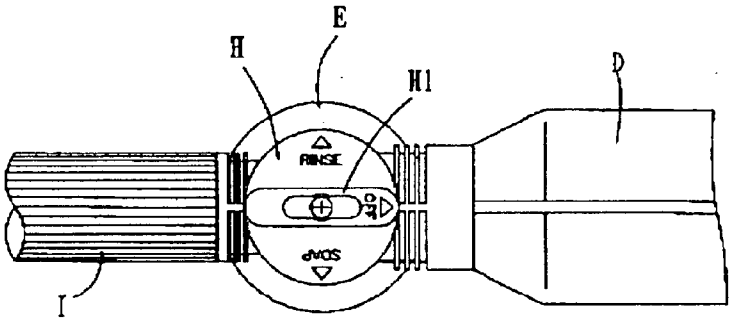
FIG. 2B PRIOR ART
Figure 2A:
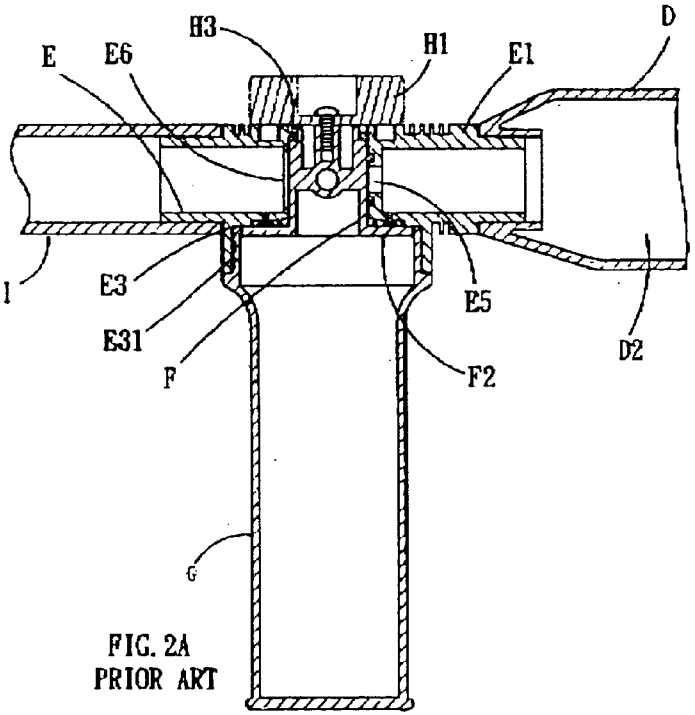
FIG. 2A PRIOR ART
Figure 2D:
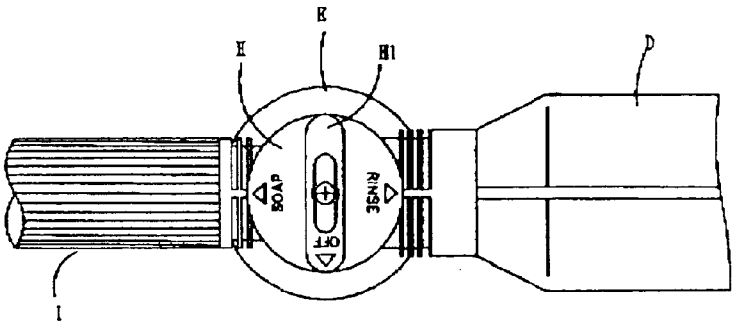
FIG. 2D PRIOR ART
Figure 2C:
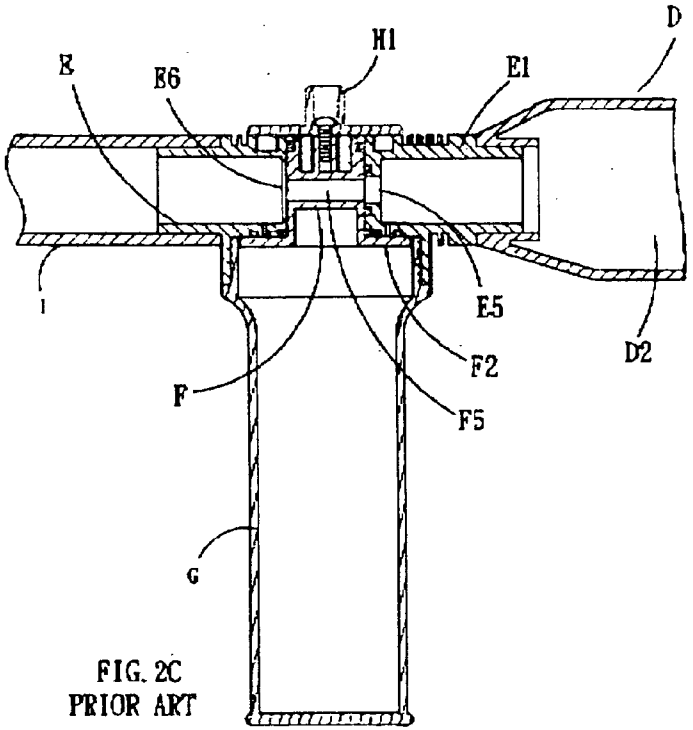
FIG. 2C PRIOR ART
Figure 3:
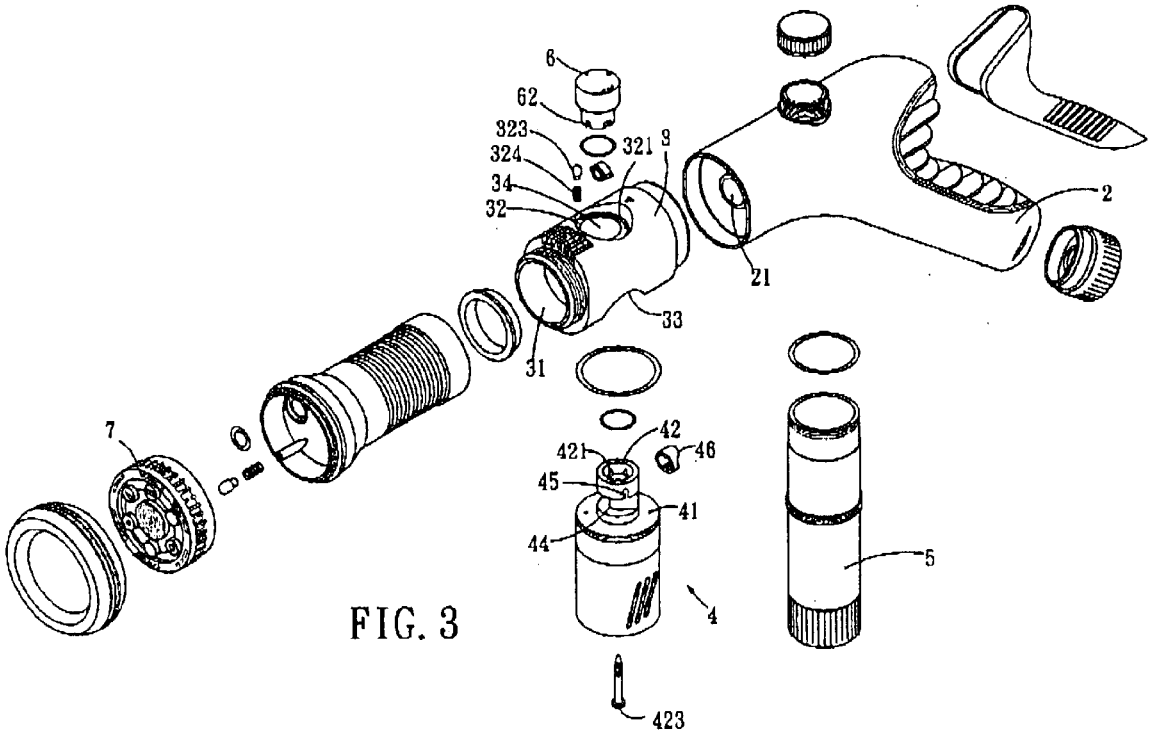
FIG. 3 is an exploded perspective view of the present invention.
Figure 3A:
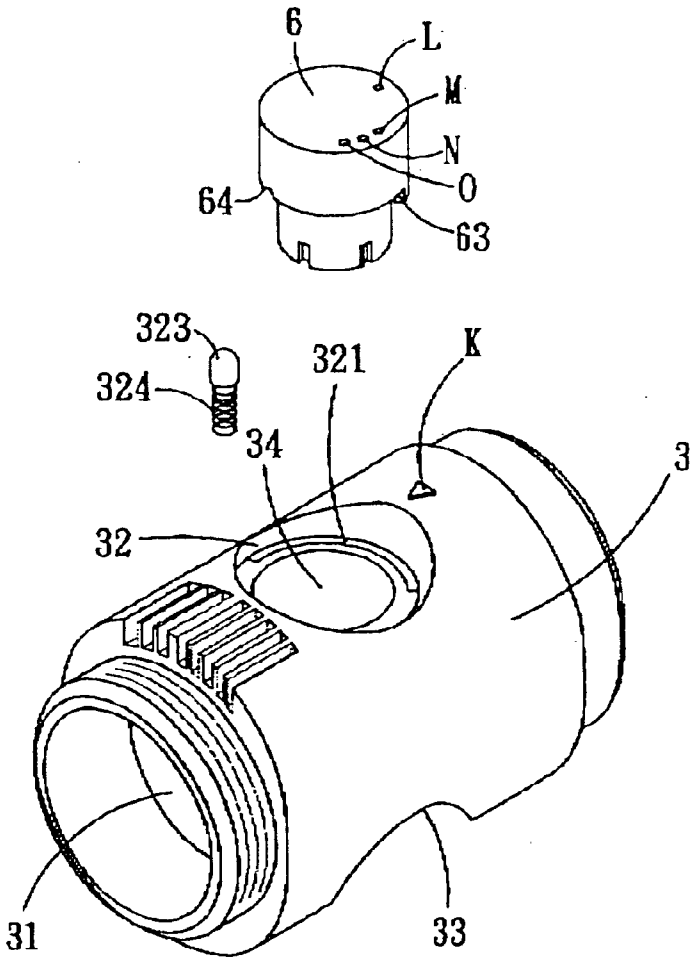
Figure 4A:
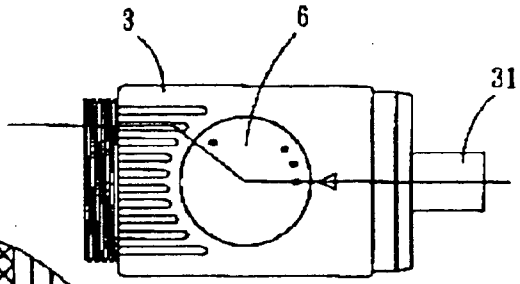
FIG. 4 is a cross-sectional view of the connector, connective hose, setting sleeve, adjustment mount, and sleeve of the present invention.
Figure 4B:
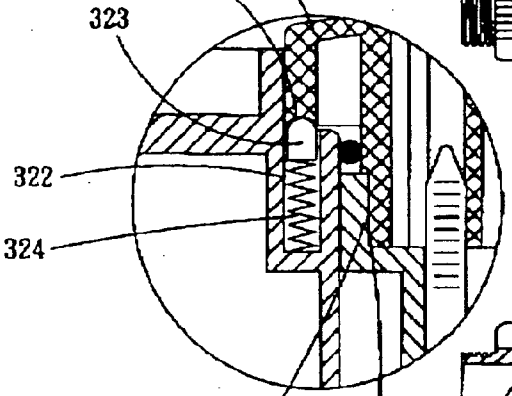
Figure 4:
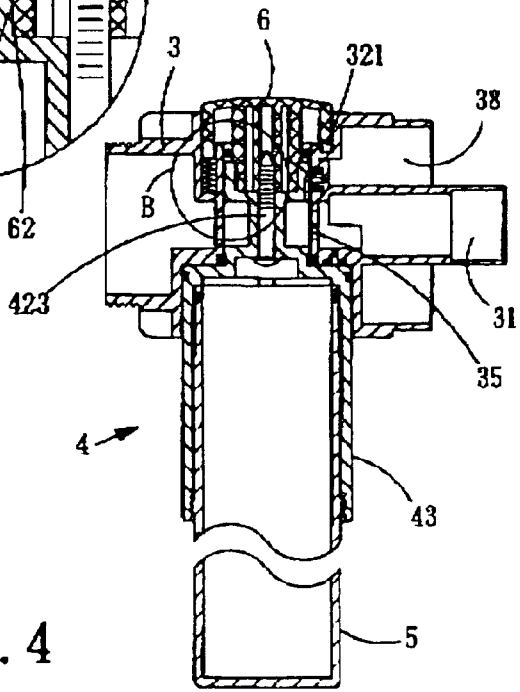

Referring to FIG. 3, FIG. 3-A, FIG. 4, FIG. 4-A, and FIG. 4-B, the structure of the invention is comprised of a car wash gun body 2, a connector 3, an adjustment mount 4, a sleeve 5, a setting sleeve 6, and a nozzle 7.

The car wash gun body 2 has a water passage 21 formed inside and its top end extends forward.

The connector 3 is fastened to the front extent of the car wash gun body 2 and has a water passage 31 formed inside that is in continuity with the water passage 21. Situated perpendicularly at the approximate center in the upper and lower ends, respectively, are the receptacles 32 and 33. An indication symbol K is formed at the approximate center on the top surface of the connector 3 adjacent to the upper receptacle 32. A curved race 321 is disposed along the top surface of the upper receptacle 32 and a through-hole 34 of relatively smaller diameter extends through the center of the two receptacles 32 and 33. Passages 35 and 36 formed through the approximate centers of the parallel two sides of the said through-hole 34 are in continuity with the water passage 31 and an output hole 37 of the water passage 31 is situated in the lower receptacle 33.

The adjustment mount 4 is installed in the lower receptacle 22 in continuity with the through-hole 34 at the upper extent of which is a soap solution output hole 41 that is positionally coordinated with the output hole 37 in the lower receptacle 33 from the water passage 31 through the interior section of the connector 3. A circular recess 42 is formed at the center of the top section, with an insertion lock tab 421 disposed along the circumference of the circular recess 42, and a mounting hole 422 formed at the center.

The sleeve 5 is filled with a soap solution and installed into the lower receptacle 33 at the approximate center of the connector 3.

The setting sleeve 6 is installed into the upper receptacle 32 of the connector 3 and the indication markings L, M, N, and O are formed along the periphery of the top surface, enabling selective alignment with the indication symbol K. A mounting hole is formed at the center of its bottom section to enable the attachment and mounting to the adjustment mount 4 by means of the screw 423. Catch slots 62 are formed in the circumferential edge of the bottom section, enabling mounting to the insertion lock tabs 421 disposed along the circumference of the circular recess 42 of the adjustment mount 4. A positioner tab 63 is formed at the center section of the bottom end that is aligned with the curved race 321 to enable guided movement between the two components.

The nozzle 7 is attached to the front end of the connector 3.

The major innovation of the invention herein is the assembly of a liquid wax chamber 38 at the circumferential edge and then annularly attached between the end section of the connector 3 and the car wash gun body 2. The through-hole 34 is situated at the liquid wax chamber 38, then an output hole 39 is formed, which in coordination with a mounting slot 43 extending from the bottom section of the adjustment mount 4, enables the fastening of the sleeve 5. The soap solution output hole 41 that is positionally coordinated with the output hole 37 is situated on the center section and top surface of the mounting slot 43. The passages 35 and 36 are in continuity with the water passage 31, and a curved flow channel 44 is formed into one side. Formed at the top end and at an appropriate position in the circumferential edge of the curved flow channel 44 is a groove 45 that is in continuity with the through-hole 34 as well as the output hole 39 of the liquid wax chamber 38, with a reverse profile washer 46 mounted on its other side, thereby enabling the blockage of the water flow through the water passage 21 and the contiguous water passage 31.

Figure 5B:
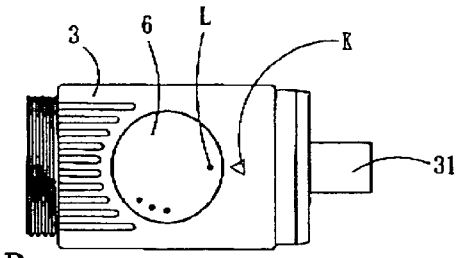
FIG. 5 is a cross-sectional view of the connector, connective hose, setting sleeve, adjustment mount, and sleeve in the structure of the present invention in the water-off mode.
Figure 5A:
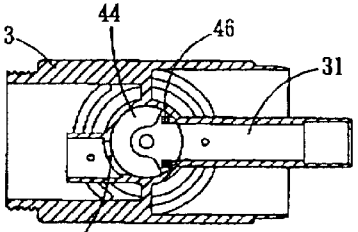
Figure 5:
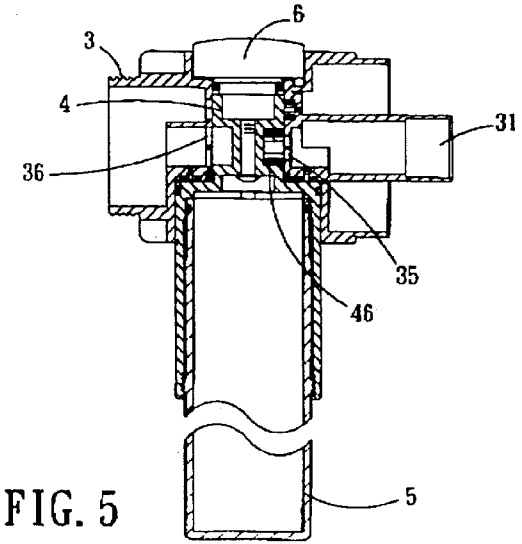

As illustrated in FIG. 5, FIG. 5-A, and FIG. 5-B, the user only has to directly rotate the adjustment mount 4, rotating the adjustment position of the marking L into alignment with the indication symbol K. The upper section of the adjustment mount 4 is situated such that the through-hole 34 and the passages 35 and 36 in the center section of the connector 3 are in continuity with the curved flow channel 44 formed into one side of the water passage 31, and the reverse profile washer 46 is mounted on its other side, the initial water flow through the water passage 21 and the contiguous water passage 31 is totally blocked, enabling the car wash gun to completely close-off the water flow to and precluding discharge from the nozzle 7.

Figure 6B:
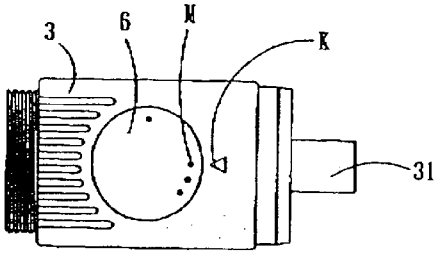
FIG. 6 is a cross-sectional view of the connector, connective hose, setting sleeve, adjustment mount, and sleeve in the structure of the present invention in the water-only output mode.
Figure 6A:
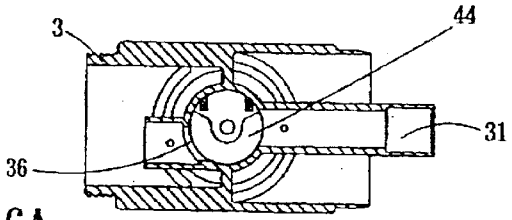
Figure 6:
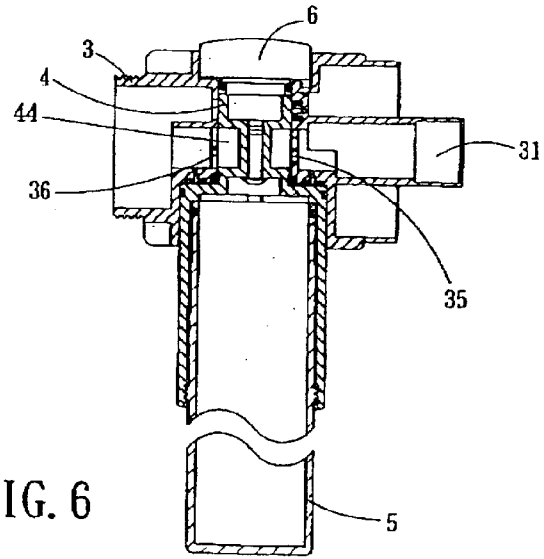

Referring to FIG. 6, FIG. 6-A, and FIG. 6-B, when the user rotates the adjustment mount 4 once again, rotating the adjustment position of the marking M into alignment with the indication symbol K, since the upper section of the adjustment mount 4 is situated such that the through-hole 34 and the passages 35 and 36 are in continuity with the curved flow channel 44, the initial water flow through the water passage 21 and the contiguous water passage 31 occurs as the requisite passageways are now in an open state, allowing water flow to be discharged from the nozzle 7.

Figures 7, 7A, 7B, 7C:
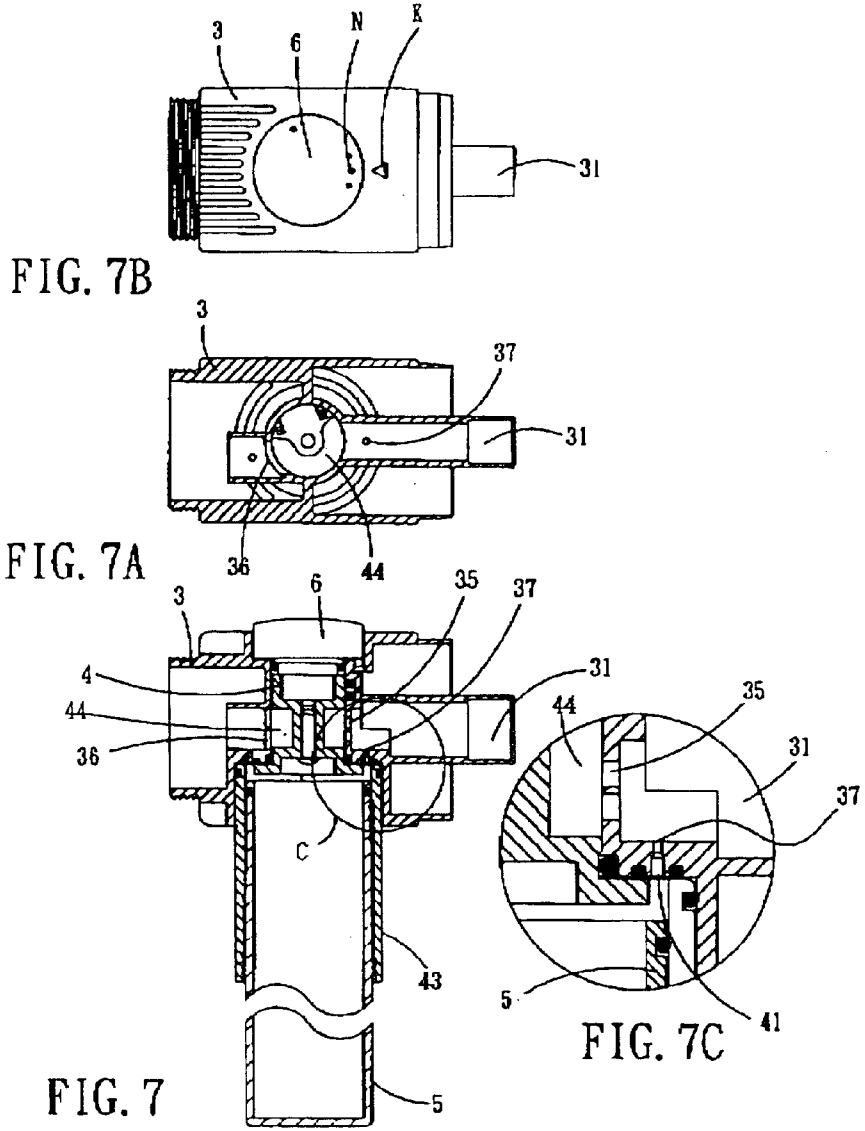
FIG. 7 is a cross-sectional view of the connector, connective hose, setting sleeve, adjustment mount, and sleeve in the structure of the present invention in the combination water and soap output mode.

Referring to FIG. 7, FIG. 7-A, FIG. 7-B, and FIG. 7-C, when the user rotates the adjustment mount 4 once again, rotating the adjustment position of the marking N into alignment with the indication symbol K, the through-hole 34 and the passages 35 and 36 in the center section of the connector 3 are in continuity with the curved flow channel 44 formed into one side of the water passage 31. Thus, in addition to the initial water flow through the water passage 21 and the contiguous water passage 31, due to the output hole 37 of the water passage 31 the positional arrangement of the soap solution output hole 41 at the mounting slot 43, the car wash gun is also capable of achieving a combination output as sourced from the sleeve 5 filled with soap solution.

Figures 8, 8A, 8B, 8C:
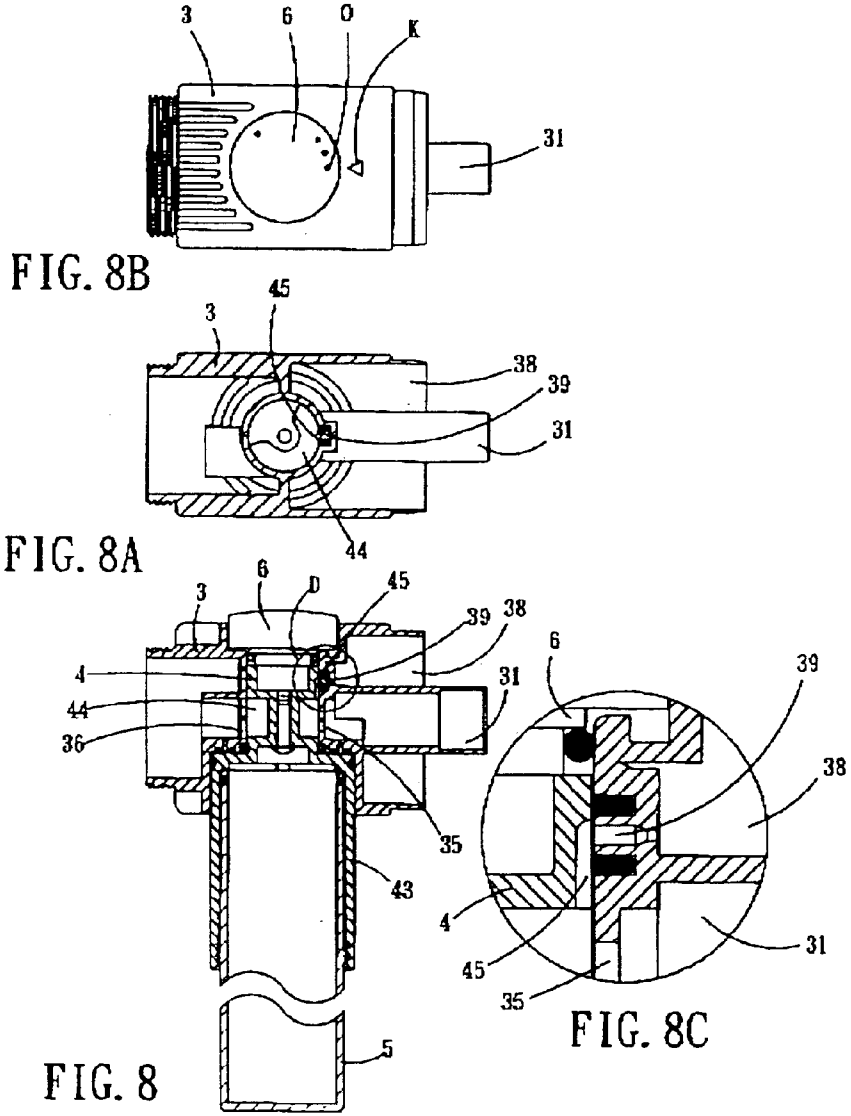
FIG. 8 is a cross-sectional view of the connector, connective hose, setting sleeve, adjustment mount, and sleeve in the structure of the present invention in the combination water and wax output mode.

Referring to FIG. 8, FIG. 8-A, FIG. 8-B, and FIG. 8-C, when the user rotates the adjustment mount 4 once again, rotating the adjustment position of the marking O into alignment with the indication symbol K, in addition to the initial water flow through the water passage 21 and the contiguous water passage 31, the groove 45 formed at the top end and at an appropriate position in the circumferential edge of the curved flow channel 44 is now also in state of continuity with the through-hole 34 as well as the output hole 39 of the liquid wax chamber 38. Thus, the car wash gun is also capable of controlling the water flow to achieve a combination output sourced from the liquid wax chamber 38 filled with a liquid wax solution.

Referring to FIG. 3, FIG. 3-A, FIG. 4, FIG. 4-A, and FIG. 4-B, the mounting slot 322 on the top surface of the upper receptacle 32 has ball bearing 323 and spring 324, providing a mounting structure to provide for rotational positioning after the entire adjustment mount 4 is assembled to the setting sleeve 6.

In summation of the foregoing section, the invention herein has more convenience and efficiency than the conventional car wash gun structures and provides a stable directly rotatable adjustment mount for selectively controlling water flow stoppage, water-only output, combination soap output, and combination liquid wax output during utilization.

What is claimed is:

1. A multifunction car wash gun comprising:

a car wash gun body, a connector, an adjustment mount, a sleeve, a setting sleeve, and a nozzle, wherein: the carwash gun body has a first water passage; the connector is fastened to a front of the car wash gun body and has a second water passage that is in continuity with the first water passage, the connector including upper and lower receptacles, a through-hole extending through centers of the receptacles, two passages formed through two sides of the through-hole that are in continuity with the second water passage, and an output hole; the adjustment mount is installed in the lower receptacle and is in continuity with the through-hole, at an upper extent of which is a soap solution output hole that is positionally coordinated with the output hole in the lower receptacle; the sleeve is adapted to be filled with a soap solution and installed into the adjustment mount; the setting sleeve is installed in the upper receptacle and attached to the said adjustment mount; and the said nozzle is attached to the connector; a liquid wax chamber is formed between the connector and the car wash gun body, with the through-hole situated at the liquid wax chamber, and including a wax output hole; the soap solution output hole being situated on a center section and top surface of a mounting slot; the two passages are in continuity with the second water passage, and a curved flow channel formed into one side including, at a top end and in a circumferential edge of the said curved flow channel a groove that is in continuity with the through-hole as well as the was output hole of the liquid wax chamber; a reverse profile washer located so as to enable blockage of the water flow through the first water passage and the second water passage whereby direct rotation of the adjustment mount selectively controls operation of the car wash gun including water flow stoppage, water-only output, combination water and soap solution output, and combination water and liquid wax output modes.

2. The multifunction car wash gun of claim 1 further comprising a first mounting slot at a center and a bottom of the setting sleeve coordinated with a second mounting slot on a top surface of the upper receptacle of the connector; a steel ball biased by a spring in the second mounting slot, the ball engaging the first mounting slot to form a mounting structure to provide for rotational positioning of the setting sleeve.

* * * * *